US006469678B1

(12) United States Patent
Pullen

(10) Patent No.: US 6,469,678 B1
(45) Date of Patent: Oct. 22, 2002

(54) ANTENNA MOUNTING APPARATUS

(75) Inventor: Michael Alan Pullen, Schaumburg, IL (US)

(73) Assignee: Andrew Corporation, Addison, IL (US)

( * ) Notice: Subject to any disclaimer, the term of this patent is extended or adjusted under 35 U.S.C. 154(b) by 0 days.

(21) Appl. No.: 09/898,117

(22) Filed: Jul. 3, 2001

(51) Int. Cl.[7] ..... H01Q 1/32
(52) U.S. Cl. ..... 343/888; 343/888; 343/906
(58) Field of Search ..... 343/713, 715, 343/888, 900, 906

(56) References Cited

U.S. PATENT DOCUMENTS 3,928,952 A 12/1975 Whyte
4,170,777 A * 10/1979 Liautaud ..... 343/715
4,173,761 A 11/1979 Liautaud
4,190,839 A * 2/1980 Liautaud ..... 343/715
4,198,638 A 4/1980 Carolus
4,882,591 A * 11/1989 Galvin et al. ..... 343/715
5,271,684 A 12/1993 Phillips
5,583,522 A 12/1996 Radomski et al.
5,616,043 A * 4/1997 Liou ..... 439/322
5,896,110 A 4/1999 Kojima

* cited by examiner

*Primary Examiner*—Don Wong
*Assistant Examiner*—Shih-Chao Chen
(74) *Attorney, Agent, or Firm*—Vedder, Price, Kaufman & Kammholz

(57) ABSTRACT

An apparatus for mounting an antenna onto a vehicle including a base assembly and a fastener. The base assembly is removably attached to the vehicle and includes a mounting portion and a housing. The mounting portion includes a main body having at least one arm extending therefrom, a top portion, and at least one engaging element for removably attaching the base assembly to the vehicle. The housing is connected to the base. The fastener has guide structure for engaging at least one arm for securing the base assembly to the vehicle.

20 Claims, 3 Drawing Sheets

ANTENNA MOUNTING APPARATUS

BACKGROUND OF THE INVENTION

The invention relates generally to antenna-mounting apparatus, and in particular to an apparatus for mounting an antenna onto a vehicle.

In the past, there have been various devices for mounting an antenna onto a vehicle. The current conventional method for mounting an antenna onto a vehicle includes inserting a threaded stud into an aperture in a vehicle panel from inside the vehicle. One installer holds the threaded stud in position inside the vehicle, while another installer interengages a threaded lock-nut onto the threaded stud from the vehicle exterior. The antenna body is also fastened onto the threaded stud from the vehicle exterior. An example of this type of prior art automobile radio antenna having a threaded stud and an interconnected antenna body is shown in U.S. Pat. No. 5,583,522 issued Dec. 10, 1996 to RADOMSKI et al. entitled Automobile Antenna Mounting Arrangement, and U.S. Pat. No. 5,896,110 issued Apr. 20, 1999 to KOJIMA entitled Vehicle Antenna Attaching Apparatus Suitable For Attaching A Rod-shaped Antenna To A Vehicle.

In each of the above patents, the threaded stud must be held in position inside the vehicle by one installer while another installer interengages the nut and the stud outside the vehicle. Accordingly, a major disadvantage of these prior art designs is that two workers are necessary in order to install the antenna. Another disadvantage is that a power tool is required to properly install the nut on the threaded stud in order to complete assembly of the apparatus. Power tools are difficult to control and often scratch a painted finish of the vehicle. Consequently, the paint must be repaired increasing cost and time delays to the manufacturer. Additionally, power tools easily over-torque the nut and strip the threads of the stud or nut. Consequently, the entire assembly must be removed and reinstalled, further increasing costs. Often, another further step required in the assembly of these prior art antenna mounting apparatus is the mounting of the antenna base. This multi-part design is disadvantageous and further increases the cost of manufacture. Furthermore, multiple installers add to overhead, increasing costs.

Further prior examples of vehicle mounting arrangements are shown in U.S. Pat. No. 3,928,952 issued Dec. 30, 1975 to WHYTE entitled Antenna Mount; U.S. Pat. No. 4,173,761 issued Nov. 6, 1979 to LIAUTAUD entitled Mobile Antenna Mounting Assembly, and U.S. Pat. No. 4,198,638 issued Apr. 15, 1980 to CAROLUS entitled Telescoping Antenna Mast Connector.

Therefore, there is a need for an antenna mounting apparatus for mounting an antenna onto a vehicle having a minimum number of parts which requires only one installer, clearly signals desired tightening torque, and eliminates the opportunity for damage to the exterior finished surfaces of the vehicle.

SUMMARY OF THE INVENTION

The apparatus of the present invention is primarily for use on a vehicle. In one principal aspect of the present invention, the apparatus includes a base assembly which is removably attached to the vehicle and a fastener for securing the base assembly to the vehicle. The base assembly includes a mounting portion and a housing. The mounting portion includes the main body having at least one arm extending from the main body, a top portion, and at least one engaging element for removably attaching the base assembly to the vehicle. The housing is connected to the base. The fastener has a guide structure for engaging at least one arm and securing the base assembly to the vehicle.

In another principle aspect of the invention, the apparatus for mounting an antenna includes a base assembly and a nut. The base assembly includes a mounting portion, a dielectric insert, a housing, a threaded insert, and an antenna. The mounting portion includes a cylindrical main body having a pair of arms extending in opposition disposed at a free end of the main body, an indexing element and an enlarged top portion having a centrally disposed aperture in connection with a bore extending through the mounting portion. The dielectric insert is received and retained within the aperture and bore. The housing is connected to the mounting portion and includes a centrally disposed aperture axially aligned with the main body aperture and bore for receiving and retaining the threaded insert. The threaded insert includes a first end for engaging the antenna and a second end which projects through the dielectric insert adapted for connection with an antenna circuit. The nut includes a guide structure having a contoured surface for engaging the arms and securing the base assembly to the vehicle.

BRIEF DESCRIPTION OF THE DRAWINGS

The features of the present invention which are believed to be novel are set forth with particularity in the appended claims. The invention, together with further objects and advantages may be understood by reference to the following description taken in conjunction with the accompanying drawings in the several figures of which like reference numerals identify like elements:

DETAILED DESCRIPTION OF THE PREFERRED EMBODIMENTS OF THE INVENTION

Figure 1:
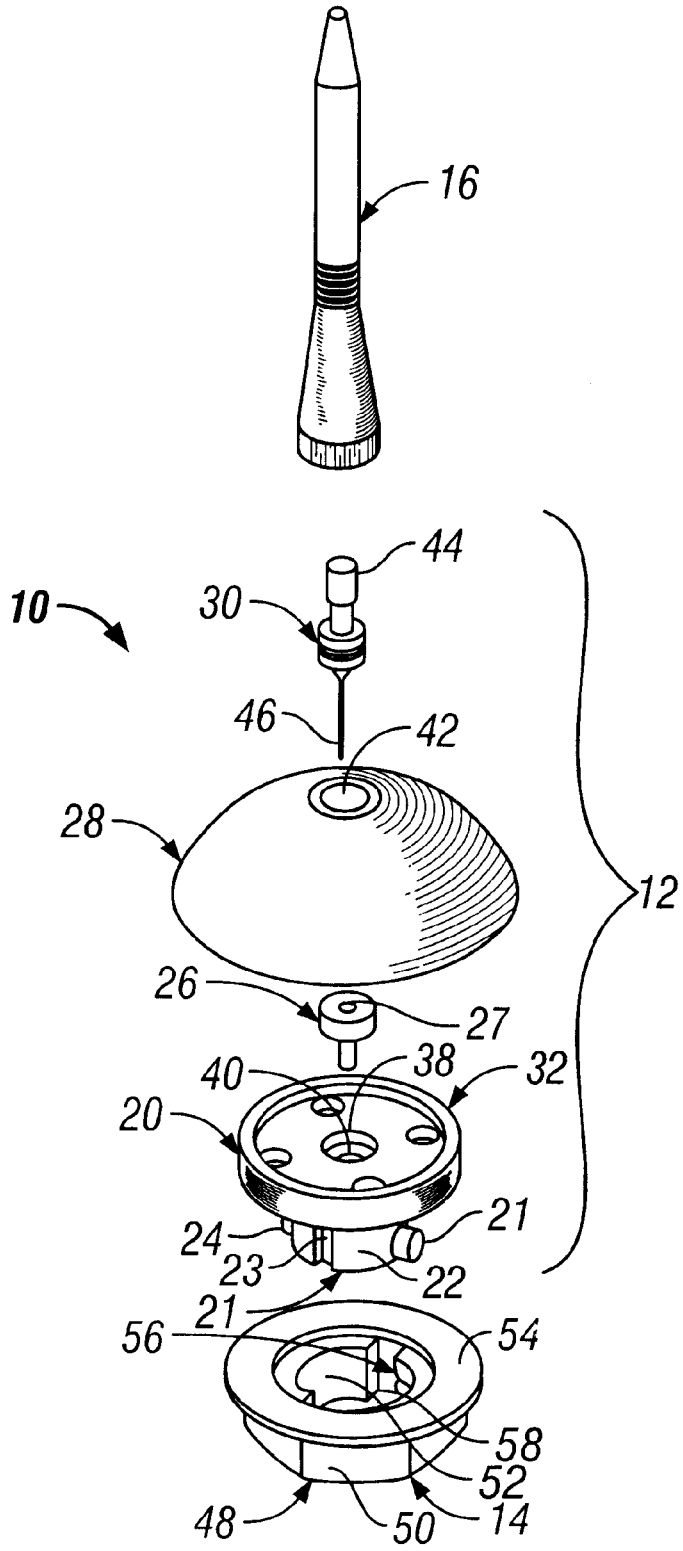
FIG. 1 is an exploded view of the apparatus of the present invention.

FIG. 1 shows an exploded view of the apparatus 10 of the present invention for mounting an antenna onto a vehicle. The apparatus 10 includes a base assembly 12, a fastener 14 and an antenna 16. The antenna 16 may function in any frequency bands and may have any design, shape or size. For example, the antenna 16 of the present invention may be a standard quarter wave antenna, a wireless phone antenna, a global positioning system ("GPS") antenna, or an AM/FM antenna. Other antennas may be used as required by each specific application.

The base assembly 12 includes a mounting portion 20, a dielectric insert 26, a housing 28, and a threaded insert 30. The mounting portion 20 includes cylindrical main body 22 having a pair of arms 24 extending in opposition and disposed at a free end 21 of the main body 22. An indexing element 23 is formed in the main body 22 for correctly orientating the base assembly 12 relative to the vehicle. The indexing element 23 may be formed in various different shapes, designs, and sizes. For example, the indexing element 23 of the present invention is shown as a groove or slot formed in the outer surface of the main body 22 extending in the direction of the longitudinal axis of the main body 22. The indexing element 23 may also be formed as an aperture or a series of apertures, a projection or a series of projections, a key way, a deflectable arm or any other like structures. The indexing element 23 may also be associated with an enlarged top portion 32.

The enlarged top portion 32 is separated from the main body 22 by a shoulder 34 (see FIG. 2) formed at a first end 36 of the main body 22. The top portion 32 is shown as having a larger diameter than the main body 22 however, both the top portion 32 and the body 22 are substantially coaxially aligned. An aperture 38 is centrally disposed in the enlarged top portion 32 and in communication with a bore 40 extending through the mounting portion 20 to the free end 21 substantially along the longitudinal axis. A dielectric insert 26 is configured relative to the aperture 38 and bore 40 such that when installed, the dielectric insert 26 is received and retained within the aperture 38 and bore 40. For example, the dielectric insert 26 may inferringly engage the aperture 38 and bore 40, or a chemical composition or mechanical structure may be used to retain the dielectric insert 26 therein. A bore 27 extends through the dielectric insert 26 for purpose explained below.

The housing 28 is configured as a cover which is attached to the mounting portion 20. The housing 28, as shown, has a substantially hemispherical configuration. However, the shape, size and configuration of the housing shall not be so limited because application and use of the present invention with different vehicles often requires modification in order to correctly install. For example, the vehicle may have a curved or angled panel to which the apparatus is attached. The shape and surfaces of the mounting portion and housing must be modified to match the contour or curve of that panel. Further, certain vehicle manufacturers may desire differently shaped housing. Accordingly, a great many shapes and configurations may be incorporated into the present invention.

The housing 28 may be removably attached or permanently affixed to the mounting portion 20. For example, the housing 28 may be removably snap-fitted or ultrasonically welded, screw fastened or chemically adhered.

A centrally disposed aperture 42 is axially aligned with the aperture 38 and bore 40 of the main body 22 when the base assembly 12 is assembled for engaging the threaded insert 30. The threaded insert 30 includes a first end 44 for engaging the antenna 16 and a second end 46 which, when installed, projects through the bore 27 in the dielectric insert 26 and is adapted for connection with an antenna circuit. The first end 44 has screw threads formed thereon which remain disposed outside the housing 28 when installed. The first end 44 may also have other interconnection devices formed thereon, for example, phonojack, mini-phonojack, bayonet, or other similar structures.

The fastener 14 of the present invention is configured as a hex nut including a body 48 having an outer surface 50 and an inner surface 52, and a flange 54. However, it is within the teachings of the present invention that other shapes, designs and configurations could be utilized for the fastener to provide the same function. A guide structure 56 is formed in the inner surface 52 of the fastener 14. The guide structure 56 includes a contoured surface 58 for engaging the arms 24 in order to secure the base assembly 12 to the vehicle as will be detailed below.

Figure 2:
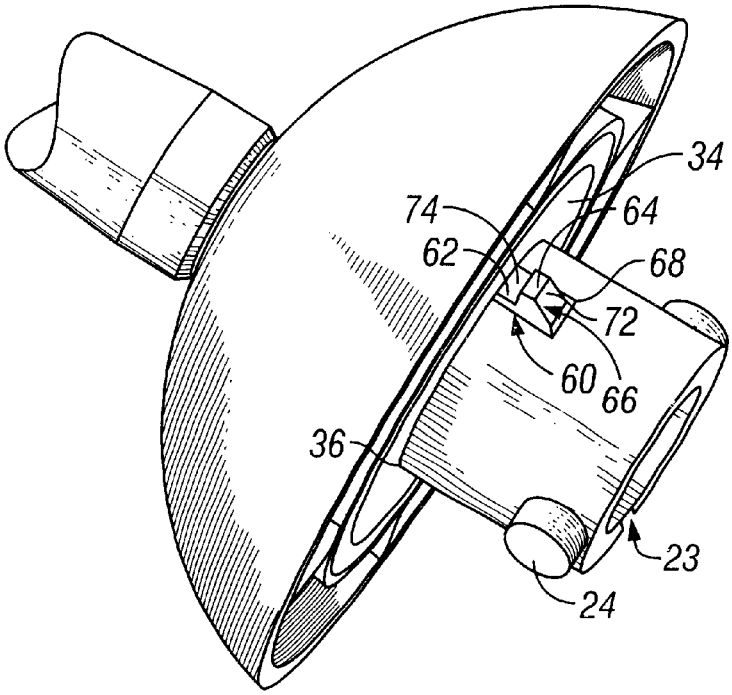
FIG. 2 is a bottom perspective view of the base assembly of the present invention.

FIG. 2 shows a bottom perspective view of the base assembly 12 as assembled and ready for installation onto a vehicle. The main body 22 further includes an engaging element 60 for snap-fitting the base assembly 12 to the vehicle. The engaging element 60 includes an arm 62 connected to the main body at the first end 36 and a structure 64 at a free end 66 of the arm 62. A slot or groove 68 is formed in the main body 22 in order to permit the engaging element 60 to deflect during installation such that the base assembly snap-fits to the vehicle.

Figure 3:
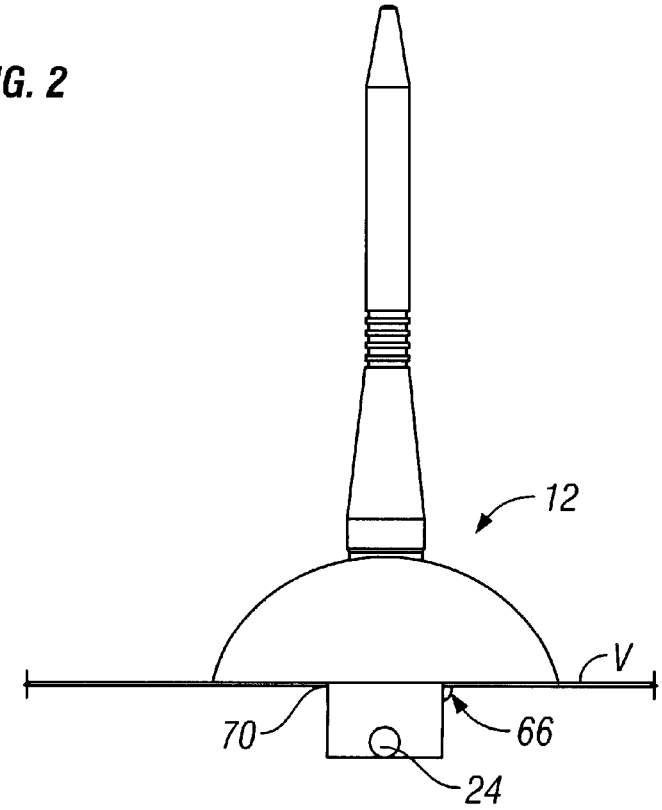
FIG. 3 is a perspective view of the base assembly of the present invention removably attached to a vehicle.

FIG. 3 shows a perspective view of the base assembly 12 installed onto a vehicle V panel. The indexing element 23 is aligned with an indexing portion of an aperture 70 on the vehicle V in order to properly align the base assembly 12 relative to the vehicle V so that the main body 22 may be inserted through the aperture 70. A leading edge 72 (FIG. 2) of the structure 64 contacts an edge of the aperture 70. In response thereto, the arm 62 deflects inwardly to permit the main body 22 to continue insertion into the aperture 70. A recess 74 defined between the structure 64 and the shoulder 34 accepts a portion of the aperture 70 when the arm 62 returns to its original position whereby the mounting portion 20 is snap-fit to the vehicle V. Preferably, the portion of the aperture 70 is in contact with the structure 64 and the structure 34 such that the base assembly 12 remains as positioned until it is secured to the vehicle V. Cooperation of the indexing element 23 and the engaging element 60 disposed the base assembly 12 for final installation, such that only a single installer is required.

Figure 4:
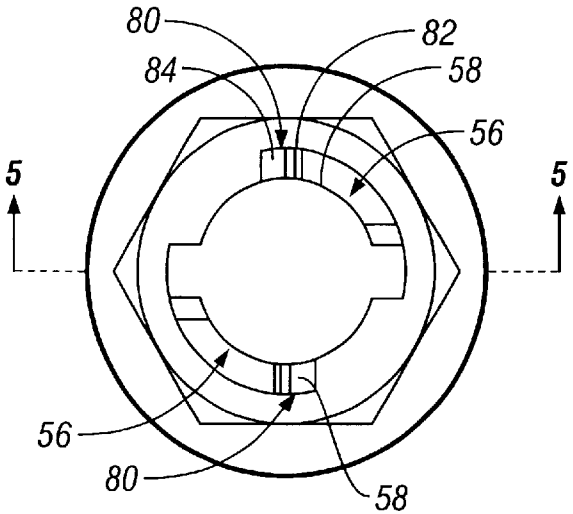
FIG. 4 is a plan view of the fastener of the present invention.
Figure 5:
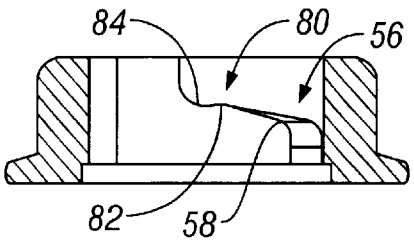
FIG. 5 is a cross-sectional view of the fastener of the present invention taken along line 5—5 in FIG. 4; and, FIG. 6 is a perspective view of the apparatus of the present invention mounted onto a vehicle.

FIG. 4 shows a top plan view and FIG. 5 shows a cross-sectional view of the fastener 14 of the present invention. The guide structure 56 includes a contoured surface 58 which may be formed as a recessed portion in the inner surface 52 of the fastener 14. The contoured surface 58 may have a helix, angled, or screw thread configuration. The contoured surface 58 has a locking structure 80 formed thereon. The over-center locking structure 80 includes an eccentric portion 82 and a pocket 84 for signaling that base assembly 12 is secured to the vehicle V, preventing over-tightening of the fastener 14 and retaining the arms 24 when the base assembly 12 is secured to the vehicle V. The guide structure 56 is configured such that a quarter-turn of the fastener 14 secures the base assembly 12 to the vehicle V. As shown in FIG. 4 the contoured surface extends over only 90° of the inner surface 52 of the fastener 14.

Figure 6:
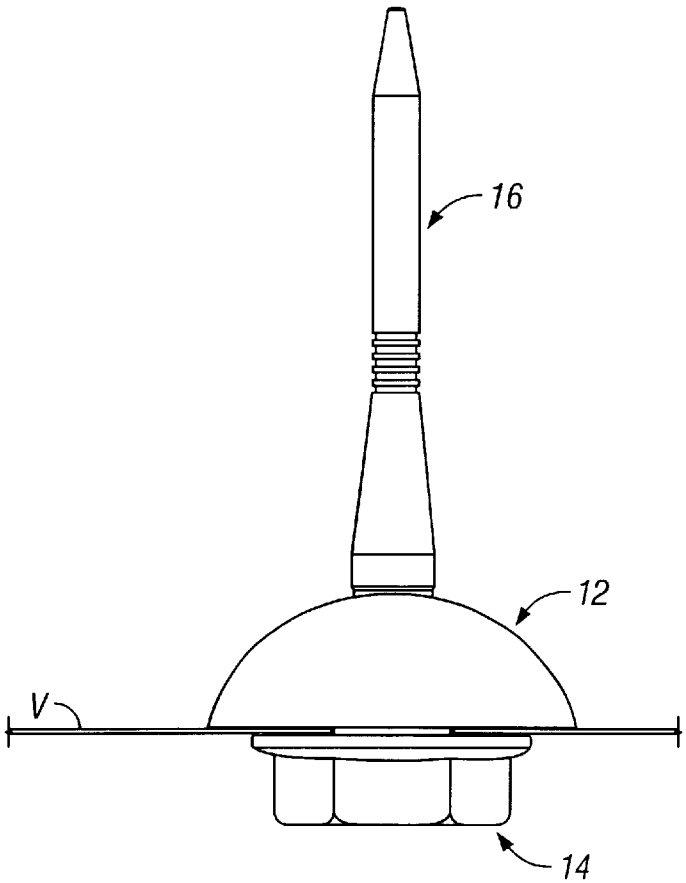

FIG. 6 shows a perspective view of the apparatus 10 mounted onto a vehicle V. The arms 24 of the base assembly 12 engage the guide structure 56 formed in the fastener 14. A quarter-turn or 90° of rotation, causes the arms to ride up and over the center of the eccentric surface 82 such that the arms come to final resting position in the pocket 84. It will be understood by one of ordinary skill in the art that the present invention prevents over-tightening of the fastener 14. Accordingly, there is less parts breakage and waste. Further, there is less damage to the vehicle because the tool used to tighten the fastener 14 is used from inside the vehicle. Consequently, the exterior painted surface is not damaged. This results in considerable cost savings. Additionally, cost savings are further reduced by the small number of parts used in the present invention.

The invention is not limited to the particular details of the apparatus depicted and other modifications and applications may be contemplated. For example, the mounting portion, dielectric insert and housing may be integrally molded. Also, various different structures and configurations may be used for the housing and fastener. Furthermore, the configuration of the contoured surface may be modified to provide desired torque specifications. Certain other changes may be made in the above-described apparatus without departing from the true spirit and scope of the invention here involved. It is intended, therefore, that the subject matter of the above depiction shall be interpreted as illustrative and not in a limiting sense.

What is claimed is:

1. An apparatus for mounting an antenna onto a vehicle, comprising:

a base assembly removably attached to the vehicle including a mounting portion and a housing;

the mounting portion including a main body having at least one arm extending from the main body, a top portion, and at least one engaging element for removably attaching the base assembly to the vehicle;

the housing connected to the base assembly; and, a fastener having a guide structure for engaging the at least one arm and thereby securing the base assembly to the vehicle.

2. The apparatus as recited in claim 1, wherein the at least one arm includes a pair of arms disposed in opposition on said main body adjacent a free end of said main body.

3. The apparatus as recited in claim 1, wherein the main body further includes an indexing element for correctly orientating the base assembly relative to the vehicle.

4. The apparatus as recited in claim 1, wherein the engaging element includes an arm connected to said main body at a first end and having a structure at a free end of the arm such that the mounting portion snap-fits to the vehicle.

5. The apparatus as recited in claim 4, wherein said first end is adjacent to said top portion such that said arm extends along a longitudinal axis of the main body.

6. The apparatus as recited in claim 1, wherein the guide structure includes a groove formed in an inner surface of the fastener.

7. The apparatus as recited in claim 6, wherein the groove includes a contoured surface having a locking structure formed thereon.

8. The apparatus as recited in claim 7, wherein the locking structure includes an eccentric surface for signaling that the base assembly is secured to the vehicle and preventing over-tightening of the fastener.

9. The apparatus as recited in claim 7, wherein the locking structure further includes a pocket for retaining the arms when the base assembly is secured to the vehicle.

10. The apparatus as recited in claim 1, wherein a quarter-turn of the fastener secures the base assembly to the vehicle.

11. An apparatus for mounting an antenna onto a vehicle, comprising:

a base assembly and a nut;

the base assembly includes a mounting portion and a housing;

the mounting portion includes a cylindrical main body having a pair of arms extending in opposition, an enlarged top portion separated from the main body by a shoulder, and an engaging element for removably connecting the base assembly to the vehicle;

the housing connected to the top portion; and, the nut including a groove formed in an inner surface of the nut having a contoured surface for securing the base assembly to the vehicle.

12. The apparatus as recited in claim 11, wherein the arms are disposed adjacent a free end of the main body.

13. The apparatus as recited in claim 11, wherein the main body further includes an indexing element for correctly orientating the base assembly relative to the vehicle.

14. The apparatus as recited in claim 13, wherein the indexing element is formed as a longitudinally extending groove.

15. The apparatus as recited in claim 11, wherein the engaging element includes a deflectable arm connected to the main body at a first end adjacent the shoulder end and a structure disposed on a free end of the arm so that the mounting portion snap-fits to the vehicle.

16. The apparatus as recited in claim 11, wherein the base assembly is secured to the vehicle by a quarter turn of the nut.

17. The apparatus as recited in claim 11, wherein the contoured surface includes an over-center locking structure.

18. An apparatus for mounting an antenna onto a vehicle, comprising:

a base assembly and nut;

the base assembly including a mounting portion, a dielectric insert, a housing, and a threaded insert;

the mounting portion including a cylindrical main body having a pair of arms extending in opposition disposed at a free end of the main body, an indexing element, and an enlarged top portion having a centrally disposed aperture in communication with a bore extending through the mounting portion;

the dielectric insert received and retained within the aperture and bore;

the housing connected to the mounting portion and including a centrally disposed aperture axially aligned with the main body aperture and bore for receiving and retaining the threaded insert;

the threaded insert including a first end for engaging the antenna and a second end which projects through the dielectric insert adapted for connection with an antenna circuit; and, the nut including a guide structure having a contoured surface for engaging the arms and securing the base assembly to the vehicle.

19. The apparatus as recited in claim 18, wherein the contoured surface includes an over-center locking structure.

20. The apparatus as recited in the claim 18, wherein the base assembly is secured to the vehicle by a quarter turn of the locking nut.

* * * * *